US007826758B2

(12) United States Patent
Miyazawa et al.

(10) Patent No.: US 7,826,758 B2
(45) Date of Patent: Nov. 2, 2010

(54) IMAGE FORMING APPARATUS

(75) Inventors: Tomoaki Miyazawa, Mishima (JP); Takeshi Yamamoto, Yokohama (JP); Manami Haraguchi, Yokohama (JP); Kenta Kubo, Suntou-gun (JP); Juun Horie, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/729,349

(22) Filed: Mar. 23, 2010

(65) Prior Publication Data

US 2010/0172676 A1 Jul. 8, 2010

Related U.S. Application Data

(62) Division of application No. 12/104,032, filed on Apr. 16, 2008, now Pat. No. 7,715,744.

(30) Foreign Application Priority Data

Apr. 20, 2007 (JP) ..... 2007-112424
Apr. 14, 2008 (JP) ..... 2008-105178

(51) Int. Cl.
*G03G 15/00* (2006.01)
*G03G 15/09* (2006.01)

(52) U.S. Cl. ..... 399/55; 399/270; 430/111.31

(58) Field of Classification Search ..... 399/53, 399/55, 270, 285; 430/111.3, 111.31, 111.41
See application file for complete search history.

(56) References Cited

U.S. PATENT DOCUMENTS 5,168,027 A 12/1992 Taguchi et al.
5,712,069 A 1/1998 Baba et al.
6,337,966 B1 1/2002 Yamamoto
6,381,434 B1 4/2002 Yamamoto
2007/0048649 A1* 3/2007 Kobayashi et al. ..... 430/111.31
2008/0152396 A1 6/2008 Yamamoto et al.
2009/0123856 A1* 5/2009 Hotta et al. ..... 430/106.1

FOREIGN PATENT DOCUMENTS

JP 60-131549 A 7/1985
JP 64-13157 A 1/1989
JP 2-147963 A 6/1990
JP 8-160671 A 6/1996
JP 2004-21113 A 1/2004

* cited by examiner

*Primary Examiner*—Sophia S Chen
(74) *Attorney, Agent, or Firm*—Fitzpatrick, Cella, Harper & Scinto

(57) ABSTRACT

An image forming apparatus includes a photosensitive drum to which an electrostatic image is formed and a developing sleeve carrying a developer including toner carrier. An alternating voltage is applied to the sleeve to form an alternating electric field between the sleeve and the drum to develop the electrostatic image with the developer. A relation |K1|<|K2| is satisfied, where K1: a slope at an electric field intensity Ed=|(Vp2−VL)/D|, K2: a slope at an electric field intensity Eb=|(Vp1−VL)/D|, VL: a potential [V] of the electrostatic image at which a maximum density is obtained, Vp1: a peak potential [V] that provides a potential difference to move the toner toward the drum, Vp2: a peak potential [V] that provides a potential difference to move the toner toward the sleeve, and D: a closest distance [m] between the drum and the sleeve.

6 Claims, 12 Drawing Sheets a,c,e POINT Ea=|(Vdc-VL)/X| b POINT Eb=|(Vp1-VL)/X| d POINT Ed=|(Vp2-VL)/X|

X: CLOSEST DISTANCE BETWEEN PHOTOSENSITIVE MEMBER AND DEVELOPING SLEEVE

IMAGE FORMING APPARATUS

This application is a divisional of U.S. patent application Ser. No. 12/104,032, filed Apr. 16, 2008.

BACKGROUND OF THE INVENTION

1. Field of the Invention

The present invention relates to an image forming apparatus such as a copier or a printer that obtains an image by using a toner to visualize an electrostatic image formed on an image bearing member. More specifically, the present invention relates to an image forming apparatus that employs as its developer a dual-component developer which has a toner and a carrier.

2. Description of the Related Art

In conventional copiers, printers, and other image forming apparatuses that use an electrophotographic process, a surface of an electrophotographic photosensitive member (hereinafter simply referred to as "photosensitive member") serving as an image bearing member is charged uniformly, and the surface is then exposed to light in a pattern determined by image information. An electrostatic image (latent image) is thus formed on the surface of the photosensitive member. The electrostatic image formed on the photosensitive member is developed as a toner image by a developing device with the use of a developer. The toner image formed on the photosensitive member is transferred to a transfer material directly or through an intermediate transfer member. The toner image is then fixed to the transfer material, to thereby obtain a recorded image.

There are roughly two types of developers: mono-component developers which substantially consist of toner particles alone and dual-component developers which contain toner particles and carrier particles. Generally speaking, a developing method that uses a dual-component developer has advantages over one that uses a mono-component developer in that it is capable of forming a higher definition image in truer colors.

In an ordinary dual-component developer, magnetic particles (carrier) about 5 μm to 100 μm in diameter and particles of a non-magnetic toner about 1 μm to 10 μm in diameter are mixed at a given mixture ratio. The function of the carrier is to carry the charged toner to deliver the toner to a developing portion. The toner is charged with a given amount of electric charges of a given polarity through frictional charging by being mixed with the carrier.

Along with progress in terms of digitization, a pursuit of full-color, and speeding up of copiers, printers, and other image forming apparatuses that use a photographic process, their output images have recently come to be valued as original output materials, and there is even a great expectation on their entry into the printing market. Photographic process image forming apparatuses are therefore required to be capable of outputting images of higher quality (higher definition) steadily without allowing the image quality to fluctuate. To attain an image quality of that high definition, improving the development property is essential.

In a development process that uses a dual-component developer, the dual-component developer is usually carried on a developer carrying member in a developing device and transported to a developing portion, which faces an electrostatic image on a photosensitive member. The magnetic brush of the dual-component developer on the developer carrying member are brought into contact with, or close to the photosensitive member. The toner alone is then transferred to the photosensitive member by a given level of developing bias applied between the developer carrying member and the photosensitive member. A toner image corresponding to the electrostatic image is thus formed on the photosensitive member.

The developing bias that is widely employed is an alternating bias in which a DC voltage component and an AC voltage component are superimposed. The development property is improved when more toner particles are pulled apart from the carrier and put to use in the developing method. To accomplish this, the toner needs to be subjected to a higher electric field intensity.

A quick way to enhance the intensity of the electric field applied to the toner is to simply apply a higher level of developing bias between the developer carrying member and the photosensitive member. However, increasing the developing bias to a level higher than necessary may cause an injection of electric charges from the developer carrying member into the electrostatic image through the carrier, which disturbs the electrostatic image.

A conventionally popular photosensitive member is an organic photoconductor (OPC) photosensitive member in which a charge generation layer made up of an organic material, a charge transport layer, and a surface protecting layer are layered on a metal base.

On the other hand, it is a known fact that a single-layer photosensitive member, such as an amorphous silicon photosensitive member (hereinafter referred to as "a-Si photosensitive member"), is effective for forming an electrostatic image that has as high a resolution as described above. One of the reasons is as follows.

The interior charge generating mechanism of an a-Si photosensitive member is on the surface of the photosensitive member, whereas the interior charge generating mechanism of an OPC photosensitive member is located near the base of the photosensitive member. This prevents electric charges generated inside an a-Si photosensitive member from diffusing before reaching the surface of the photosensitive member, and an electrostatic image of extremely high definition is obtained as a result.

A drawback of a-Si photosensitive members is that their surface resistance is lower than that of OPC photosensitive members, which makes the influence of the above-mentioned charge injection from the developer carrying member through the carrier in a-Si photosensitive members much greater than the one in OPC photosensitive members. Therefore, when an a-Si photosensitive member is employed, a formed electrostatic image can easily be disturbed by the charge injection and the traveling of electric charges has to be restricted even more than when an OPC photosensitive member is employed by lowering the peak-to-peak voltage, Vpp, of the developing bias, which is alternating bias.

Lowering Vpp of the developing bias reduces electric charges injected from the developer carrying member to the photosensitive member through the carrier, but weakens the electric field applied to the developer. Accordingly, the force to detach the toner from the carrier is reduced and the development property is lowered.

Setting the electric resistance of the carrier is effective for forming a high quality image as proposed in Japanese Patent Application Laid-Open No. H08-160671.

However, setting the electric resistance of the carrier high is known to tend to lower the development property, in other words, the ability to detach (discharge) the toner from the carrier.

As described above, the carrier in a dual-component developer has a role of charging the toner by frictional charging in addition to the role of carrying the toner to the developing portion. The carrier is therefore charged with electric charges having a polarity reverse to that of the electric charges, with which the toner is charged. For instance, when the toner is charged with negative electric charges, the carrier is charged with positive electric charges.

In charging the toner, the electric resistance of the carrier set high makes it difficult for electric charges accumulated in the carrier to travel. The electric charges in the carrier and electric charges in the toner thus attract each other, thereby generating a large attractive force and hindering the toner from detaching from the carrier. The electric resistance of the carrier set low makes it easy for electric charges inside the carrier to diffuse on the surface of the carrier, thereby reducing the attractive force between the toner and the carrier and facilitating the detachment of the toner from the carrier.

Other methods of enhancing the electric field intensity to which the toner is subjected than increasing the developing bias applied between the developer carrying member and the photosensitive member include raising the permittivity of the carrier. When the permittivity of the carrier is high, polarized charges generated inside the carrier reduce the potential difference within the carrier and the electric field concentrates correspondingly on an air space between the carrier on the photosensitive member side and the photosensitive member. The toner adhering to the carrier will accordingly be subjected to an enhanced electric field intensity.

Raising the permittivity of the carrier is considered to facilitate the removal of even the toner once carried to the photosensitive member so that the development property is lowered.

As mentioned above, alternating bias in which a DC voltage component and an AC voltage component are superimposed is employed as the developing bias applied between the developer carrying member and the applied in a direction that moves the toner to the photosensitive member (hereinafter referred to as "development direction bias"), the toner is pulled apart from the carrier and transported to the photosensitive member. When the alternating bias is switched to apply the developing bias in a direction that moves the toner to the developer carrying member (hereinafter referred to as "pull-back direction bias"), the toner is transported toward the developer carrying member.

First, when the development direction bias is applied, the electric field intensity to which the toner is subjected is higher and more toner particles are detached from the carrier to be transported to the photosensitive member with a high permittivity carrier A than with a low permittivity carrier B from the reason described above. Also when the alternating bias is switched to apply the pull-back direction bias, the toner is subjected to a higher electric field intensity and more toner particles are detached from the photosensitive member with the high permittivity carrier A than with the low permittivity carrier B, which is inconvenient in that the influence of the permittivity on the development property is weakened.

FIG. 15 illustrates a development property difference between cases in which two types of conventional ordinary carrier having different permittivity characteristics (high permittivity carrier A and low permittivity carrier B) are employed. In FIG. 15, the axis of abscissa illustrates the peak-to-peak voltage Vpp of the developing bias and the axis of ordinate illustrates a per-unit area charge amount Q/S [C/cm$^2$] of a toner layer of a toner image formed on the photosensitive member. Q/S [C/cm$^2$] is a value calculated by multiplying a per-unit toner weight charge amount Q/M [μC/g] of the toner layer on the photosensitive member at which the maximum density is obtained by a per-unit area toner bearing amount M/S [mg/cm$^2$] of the toner layer. The Q/S [C/cm$^2$] indicates the developing performance of the developer, in other words, how much of the toner has been migrated onto the photosensitive member by overcoming the attractive force between the carrier and the toner. The maximum density is the density of a solid image and, in the case of reversal development, an image density at which the potential difference between the DC component of the developing bias and the electric potential of an image portion of the photosensitive member is maximum.

Illustrated in FIG. 15 are results that are obtained when the photosensitive member employed is an OPC photosensitive member 30 μm in film thickness (thickness of the photosensitive layer).

It is understood from FIG. 15 that Q/S [C/cm$^2$] is higher with the high permittivity carrier A than with the low permittivity carrier B regardless of the Vpp level of the developing bias. FIG. 4 illustrates the electric field dependencies of the permittivities of the high permittivity carrier A and the low permittivity carrier B. The permittivity of a carrier has characteristics that vary depending on the electric field applied to the carrier. In FIG. 4, the permittivity of the high permittivity carrier A is higher than that of the low permittivity carrier B in both the development direction bias and the pull-back direction bias. Yet, Q/S [C/cm$^2$] is higher with the high permittivity carrier A than with the low permittivity carrier B as illustrated in FIG. 15 because the influence of the permittivity upon application of the development direction bias over the electric field intensity for moving the toner to the photosensitive member is larger than the influence of the permittivity upon application of the pull-back direction bias over the electric field intensity for pulling the toner apart from the photosensitive member. Therefore, because of the electric field intensity difference caused by the difference in permittivity, the development property is better with the high permittivity carrier A than with the low permittivity carrier B.

It is understood from FIG. 15 that Q/S [C/cm$^2$] is higher with the high permittivity carrier A than with the low permittivity carrier B regardless of the Vpp level of the developing bias. FIG. 4 illustrates the electric field dependencies of the permittivities of the high permittivity carrier A and the low permittivity carrier B. The permittivity of a carrier has characteristics that vary depending on the electric field applied to the carrier. In FIG. 4, the permittivity of the high permittivity carrier A is higher than that of the low permittivity carrier B in both the development direction bias and the pull-back direction bias. Yet, Q/S [C/cm$^2$] is higher with the high permittivity carrier A than with the low permittivity carrier B as illustrated in FIG. 15 because the influence of the permittivity upon application of the development direction bias over the electric field intensity for moving the toner to the photosensitive member is larger than the influence of the permittivity upon application of the pull-back direction bias over the electric field intensity for pulling the toner apart from the photosensitive member. Therefore, because of the electric field intensity difference caused by the difference in permittivity, the development property is better with the high permittivity carrier A than with the low permittivity carrier B.

The development property is also greatly influenced by the capacitance of the photosensitive member. The development property degrades as the capacitance (per-unit area capacitance) of the photosensitive member increases and, when the degradation progresses beyond allowable limits, various image defects occur. The relation between the capacitance of the photosensitive member and the development property is described next.

Take as an example a case where a maximum density toner image is formed on the OPC photosensitive member under the following conditions; Development contrast (potential difference between the electric potential of the image portion on the photosensitive member and the DC voltage of the development bias)

Vcont=250 V

Toner charge amount Q/M=−30 μC/g

Toner bearing amount M/S=0.65 mg/cm$^2$

An electric potential (charging potential) ΔV produced by a toner layer of this toner image on an OPC photosensitive member having a film thickness of 30 μm is calculated by the following equation:

$$\Delta V = \frac{\varepsilon_t \varepsilon_0}{2\lambda t}\left(\frac{Q}{S}\right) + \frac{\varepsilon_d \varepsilon_0}{d_{th}}\left(\frac{Q}{S}\right) \text{ where} \quad \text{Equation 1}$$

$$\left(\frac{Q}{S}\right) = \left(\frac{Q}{M}\right) \times \left(\frac{M}{S}\right)$$

Q/M represents the per-unit weight toner charge amount on the photosensitive member.

M/S represents the per-unit area toner weight of a maximum density portion on the photosensitive member.

λt represents the toner layer thickness of the maximum density portion on the photosensitive member.

$d_{th}$ represents the film thickness of the photosensitive member.

$\in_t$ represents the relative permittivity of the toner layer.

$\in_d$ represents the relative permittivity of the photosensitive member.

$\in_0$ represents the permittivity of a vacuum.

Under the above conditions, ΔV=243 V and fills Vcont=250 V. In other words, electric charges in the toner layer satisfactorily fill the electric potential of the electrostatic image (charging efficiency: 97%).

The material characteristics of a-Si photosensitive members are such that their relative permittivity is about three times larger than that of OPC photosensitive members (a-Si photosensitive members: approximately 10, OPC photosensitive members: approximately 3.3). Accordingly, when an a-Si photosensitive member and an OPC photosensitive member have the same film thickness (30 μm, for example), the capacitance of the a-Si photosensitive member (e.g., $2.95\times10^{-6}$ F/m$^2$) is about three times larger than that of the OPC photosensitive member (e.g., $0.97\times10^{-6}$ F/m$^2$).

Consider a case of forming a maximum density toner image on an a-Si photosensitive member under the same conditions as in the above example where an OPC photosensitive member is employed, where the Vcont is 250 V and the toner charge amount Q/M is −30 μC/g. From the above equation, a toner amount necessary in this case to satisfy ΔV=250 V is 1.15 mg/cm$^2$, which means that the amount of the toner to be migrated onto the a-Si photosensitive member is about 1.7 times the amount of the toner on the above OPC photosensitive member. Conversely, the a-Si photosensitive member needs an about 1/1.7 of the development contrast of the OPC photosensitive member to obtain a toner bearing amount M/S of 0.65 mg/cm$^2$. An a-Si photosensitive member accordingly needs a development contrast Vcont of about 147 V to fill electric charges of a high density portion.

However, in the quick printing market or the like where a wide range of tone reproduction is required, the γ characteristic (characteristic of the image density in relation to the image exposure amount) at Vcont=147 V may be too sharp to attain a high tone reproduction property, with the result that a halftone image such as a photographic image is difficult to be reproduced.

Attempts to reduce the film thickness (photosensitive layer thickness) of OPC photosensitive members have been made in order to sharpen the electrostatic image. Also in those cases, a reduction in film thickness of the photosensitive member causes an increase in capacitance of the photosensitive member, which may cause the same problem as the one described above regarding a-Si photosensitive members.

A possible way to deal with the problem that arises from setting the relative permittivity of the photosensitive member high or reducing the film thickness of the photosensitive member is to increase Q/S [C/cm$^2$] of the toner layer of the toner image, in other words, to increase the toner charge amount Q/M [μC/g]. For instance, the toner charge amount Q/M [μC/g] is changed from −30 μC/g of the above example to −60 μC/g. In this state, if a toner bearing amount M/S [mg/cm$^2$] of 0.65 mg/cm$^2$ is obtained at a development contrast Vcont of, for example, 240 V, the electric potential ΔV produced by the toner layer is 238 V (that is, approximately 240 V) and the charging efficiency is approximately 100%.

In practice, however, increasing the toner charge amount Q/M [μC/g] increases the electrostatic force of the carrier and the toner significantly, and may seriously degrade the development property.

As has been described, with a-Si photosensitive members and other photosensitive members that have a low surface resistance, Vpp of the developing bias cannot be increased because the injection of electric charges into the electrostatic image during development has to be avoided. With a-Si photosensitive members, thin film OPC photosensitive members, and other photosensitive members that have a large capacitance, setting the toner charge amount Q/M [μC/g] high is effective in obtaining a stable and satisfactory tone reproduction property while avoiding such image defects as blank spots, except that, in some cases, setting the toner charge amount Q/M [μC/g] high seriously degrades the development property.

SUMMARY OF THE INVENTION

An object of the present invention is to provide an image forming apparatus which uses a dual-component developer including a toner and a carrier and is capable of obtaining an excellent development property while preventing an injection of electric charges into the electrostatic image through the carrier.

Another object of the present invention is to provide an image forming apparatus having a developing device that employs a developing method in which the development property is enhanced exponentially by the use of a high permittivity carrier in development.

Still another object of the present invention is to provide an image forming apparatus having a developing device that employs a developing method in which the development property is enhanced exponentially irrespective of the use of a high charge amount toner.

Yet still another object of the present invention is to provide an image forming apparatus capable of forming high definition images steadily for a long period of time irrespective of the use of a large capacitance photosensitive member.

Yet still another object of the present invention is to provide an image forming apparatus which appropriately sets carrier resistance characteristics which are varied by changes in an electric field between an image bearing member and a developer carrying member.

Further features of the present invention will become apparent from the following description of exemplary embodiments with reference to the attached drawings.

BRIEF DESCRIPTION OF THE DRAWINGS

Other objects and characteristics of the present invention will become clearer through the following detailed description when read in conjunction with the accompanying drawings in which.

DESCRIPTION OF THE EMBODIMENTS

A more detailed description will be given below with reference to the drawings on an image forming apparatus according to the present invention.

First Embodiment

Image Forming Apparatus

Figure 1:
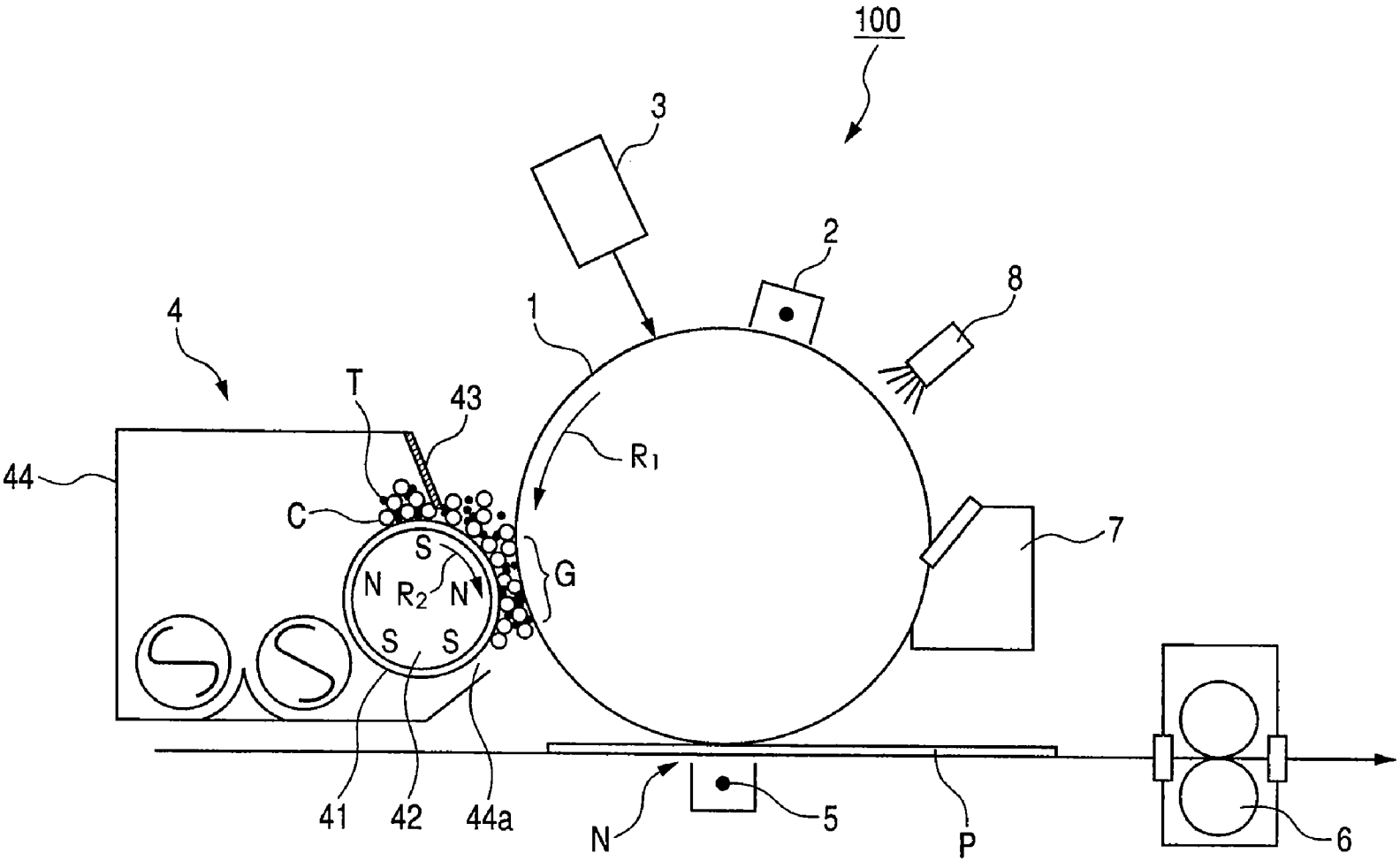
FIG. 1 is a schematic, sectional structural diagram illustrating an image forming apparatus according to an embodiment of the present invention.

FIG. 1 illustrates the schematic, sectional structure of important parts of an image forming apparatus 100 according to an embodiment of the present invention.

The image forming apparatus 100 has a cylindrical electrophotographic photosensitive member (hereinafter simply referred to as "photosensitive member") 1, which is a so-called photosensitive drum and serves as an image bearing member. Arranged around the photosensitive member 1 are a charger 2, which is a charging measure, an exposure device 3, which is an exposing measure, a developing device 4, which is a developing measure, a transfer charger 5, which is a transferring measure, a cleaner 7, which is a cleaning measure, a pre-exposure device 8, which is a pre-exposing measure, and the like. A fixing device 6 which is a fixing measure is placed along a direction in which a transfer material P is transported at a point downstream of a transfer portion N where the photosensitive member 1 and the transfer charger 5 face each other.

The photosensitive member 1 can be an ordinary OPC photosensitive member having at least an organic photoconductor layer, or an ordinary a-Si photosensitive member having at least an amorphous silicon layer.

Figure 2:
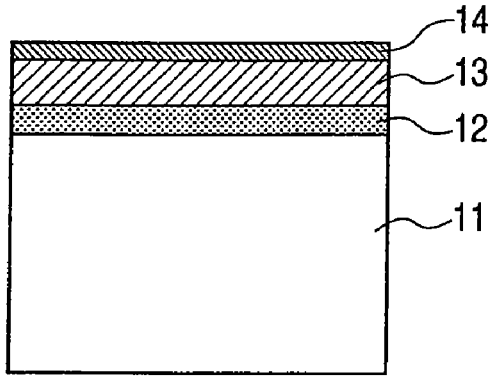
FIG. 2 is a schematic diagram illustrating an example of the layer structure of a photosensitive member.

In an OPC photosensitive member, a photosensitive layer (photosensitive film) with a photoconductor layer formed mainly of an organic photoconductor is formed on a conductive base. Ordinary OPC photosensitive members are generally structured as illustrated in FIG. 2 where a charge generation layer 12 made up of an organic material, a charge transport layer 13, and a surface protecting layer 14 are layered on a metal base 11.

Figure 3A:
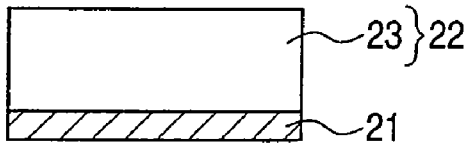
FIGS. 3A, 3B, 3C, and 3D are schematic diagrams illustrating other examples of the layer structure of a photosensitive member.

An a-Si photosensitive member has on a conductive base a photosensitive layer (photosensitive film) with a photoconductor layer formed mainly of amorphous silicon. Ordinary a-Si photosensitive members generally have the following layer structures:

An a-Si photosensitive member can have a layer structure illustrated in FIG. 3A where a photosensitive film 22 is placed on a photosensitive member supporter (base) 21. The photosensitive film 22 in this example is formed of a photoconductor layer 23 that has a photoconductivity of a-Si: H, X (H is a hydrogen atom, and X is a halogen atom).

Figure 3B:
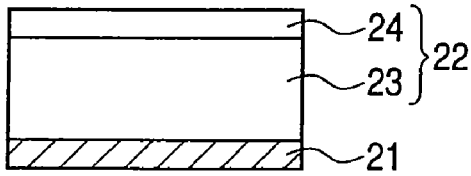

An a-Si photosensitive member illustrated in FIG. 3B has a photosensitive film 22 on a photosensitive member supporter 21. This photosensitive film 22 is formed of a photoconductor layer 23 that has a photoconductivity of a-Si: X, X and an amorphous silicon-based surface layer 24.

Figure 3C:
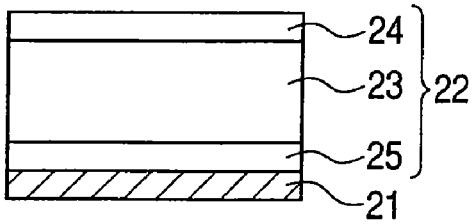

An a-Si photosensitive member illustrated in FIG. 3C has a photosensitive film 22 on a photosensitive member supporter 21. This photosensitive film 22 is formed of a photoconductor layer 23 that has a photoconductivity of a-Si: H, X, an amorphous silicon-based surface layer 24, and an amorphous silicon-based charge injection blocking layer 25.

Figure 3D:
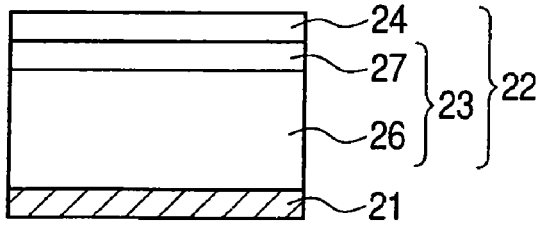

An a-Si photosensitive member illustrated in FIG. 3D has a photosensitive film 22 on a photosensitive member supporter 21. This photosensitive film 22 is formed of a photoconductor layer 23 that is constituted of a charge generation layer 26 and a charge transport layer 27, and an amorphous silicon-based surface layer 24. The charge generation layer 26 is made up of a-Si: H, X. Employing an a-Si photosensitive member is advantageous since a-Si photosensitive members are resistant to surface wear and characterized by high durability.

The photosensitive member 1 is not limited to ones that have the above layer structures, but may be a photosensitive member having another layer structure.

The photosensitive member 1 in FIG. 1 is driven and rotated at a given circumferential speed in a direction that is indicated by the arrow R of FIG. 1. The surface of the rotating photosensitive member 1 is charged substantially uniformly by the charger 2. A portion of the photosensitive member 1 that faces the exposure device 3 is irradiated with a laser light which is emitted from the exposure device 3 in response to image signals, so an electrostatic image corresponding to an original image is formed on the photosensitive member 1.

The electrostatic image formed on the photosensitive member 1 is brought to a position that faces the developing device 4 by the rotation of the photosensitive member 1, and is developed as a toner image by a dual-component developer which is inside the developing device 4 and which contains non-magnetic toner particles (toner) T and magnetic carrier particles (carrier) C. The toner image is formed from substantially the toner alone out of the components of the dual-component developer.

The developing device 4 has a developing container (developing device main body) 44, which contains the dual-component developer. The developing device 4 also has a developing sleeve 41, which serves as a developer carrying member. The developing sleeve is placed at an opening 44*a* of the developing container 44 in a manner that allows the developing sleeve 41 to rotate, and holds on the inside a roller-shaped magnet 42, which is a magnetic field generating measure.

The developing sleeve 41 in this embodiment is driven and rotated such that its surface is moved in the same direction as the surface moving direction of the photosensitive member 1 (direction B) in a portion where the developing sleeve 41 faces the photosensitive member 1, in other words, a developing portion G. The dual-component developer is carried on the surface of the developing sleeve 41, and then a controlled amount of the dual-component developer which is controlled by a regulating member 43 is transported to the developing portion G where the developing sleeve 41 faces the photosensitive member 1.

The carrier C has a function of carrying the charged toner to deliver the toner to the developing portion G. The toner T is charged with a given amount of electric charges of given polarity through frictional charging by being mixed with the carrier C. In the developing portion G, a magnetic field generated by the magnet 42 shapes the dual-component developer on the developing sleeve 41 into magnetic brush and forms a magnetic brush. The magnetic brush is, in this embodiment, brought into contact with the surface of the photosensitive member 1, and a given level of developing bias is applied to the developing sleeve 41 to make the toner T alone migrate from the dual-component developer onto the electrostatic image on the photosensitive member 1.

The toner image formed on the photosensitive member 1 is electrostatically transferred to the transfer material P by the transfer charger 5. The transfer material P is then transported to the fixing device 6, where the transfer material P is heated and pressurized so that the toner T is fixed to the surface of the transfer material P. Thereafter, the transfer material P is discharged out of the image forming apparatus as an output image.

The toner T that remains on the photosensitive member 1 after the transfer step is removed by the cleaner 7. The photosensitive member 1 cleaned by the cleaner 7 is electrically initialized through light irradiation by the pre-exposure device 8, and then the above image forming operation is repeated.

<Permittivity of a Carrier>

As mentioned above, an image forming apparatus that uses a dual-component developer including the toner T and the carrier C desirably fulfills the following.

One is to avoid an injection of electric charges into the electrostatic image during development by restricting the peak-to-peak voltage of the developing bias from increasing too much. Another is to avoid the lowering of the developing performance for enabling the toner to fill electric potential of the electrostatic image despite the need to increase the charge amount of the toner in order to deal with a photosensitive member that has as large a capacitance as $1.7\times10^{-6}$ F/m$^2$ (an amorphous silicon photosensitive member), like the photosensitive member employed in this embodiment.

A possible way to accomplish the above is to enhance the actual electric field intensity to which the toner is subjected.

One of the objects of the present invention is therefore to propose a developing method that enhances the developing property exponentially despite the use of a high charge amount toner. Another of the objects of the present invention is to enable an image forming apparatus to form high definition images steadily for a long period of time despite the use of a photosensitive member that has a large capacitance.

The present invention therefore includes setting an appropriate value for the electric field dependency of the permittivity of a carrier under the application of developing bias. A detailed description thereof is given below.

Figure 4:
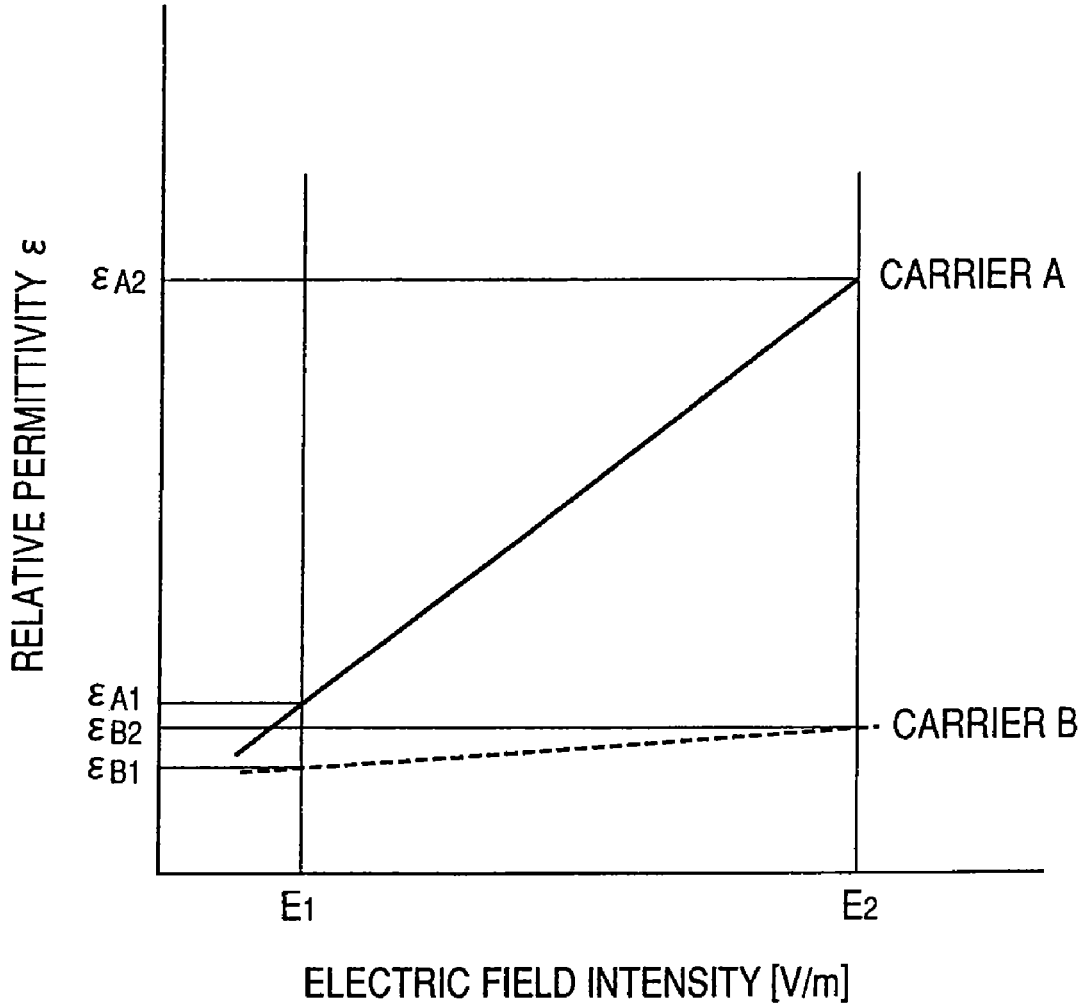
FIG. 4 is a graph illustrating permittivity fluctuations of carriers while developing bias is applied.

FIG. 4 illustrates the electric field dependency of a relative permittivity $\in$ in two types of a conventional ordinary carrier having different electric permittivity characteristics (high permittivity carrier A and a low permittivity carrier B). In FIG. 4, the axis of abscissa illustrates the electric field intensity [V/m] and the axis of ordinate illustrates the relative permittivity $\in$. The relative permittivity is expressed as permittivity/vacuum permittivity, and the vacuum permittivity is $8.854\times10^{-12}$ F/m. The relative permittivity is a value in proportion to the permittivity.

Figure 5:
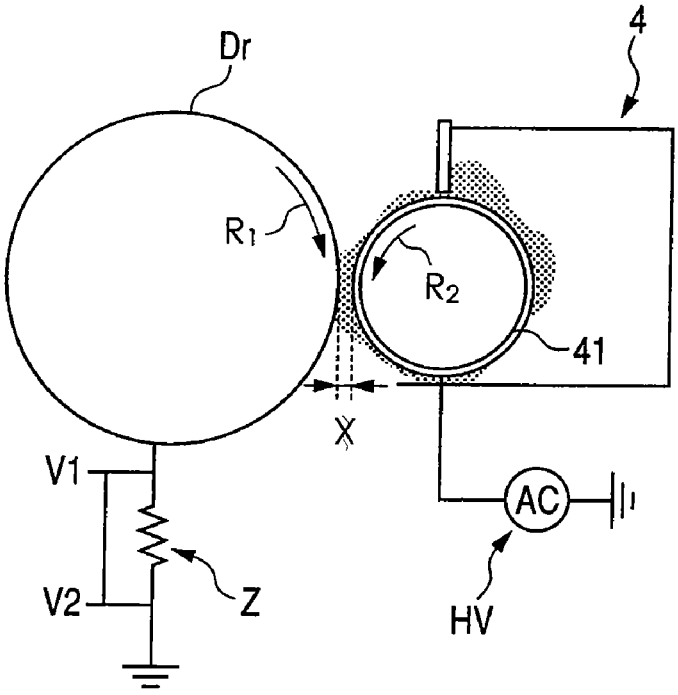
FIG. 5 is a schematic diagram illustrating how the permittivity of a carrier is measured.

The relative permittivity of a carrier can be measured by a device as illustrated in FIG. 5.

An aluminum-made cylindrical body (hereinafter referred to as "aluminum drum") Dr, which rotates at a given circumferential speed (normal surface moving speed of the photosensitive member), is faced with the developing sleeve 41 of the developing device 4 containing the carrier alone across a given distance D (normal closest distance in developing). While the developing sleeve 41 is rotated at a given circumferential speed (normal circumferential speed in developing), a power supply HV (product of NF Corporation, HVA 4321) applies an AC voltage (Sine wave) between the aluminum drum Dr and the developing sleeve 41. A response current to the applied voltage is measured while sweeping the frequency of the Sine wave, to thereby measure the impedance. In this example, the impedance of the carrier was automatically measured with a dielectric measurement system 5 (126096W) manufactured by a British company called Solartron. The impedance measuring device is denoted by Z in FIG. 5. The capacitance of the carrier was calculated from the measured impedance, and the relative permittivity of the carrier was calculated from the distance between the developing sleeve 41 and the aluminum drum and the contact area in which the carrier is in contact with the aluminum drum in relation to the calculated capacitance. The electric field dependency of the relative permittivity of the carrier was measured by sweeping the amplitude of the applied Sine wave.

The electric field intensity [V/m] illustrated by the axis of abscissa in FIG. 4 is an electric field intensity E at a position where the aluminum drum Dr and the developing sleeve 41 are in the closest proximity to each other (the closest distance D), and is calculated by dividing the voltage applied between the aluminum drum Dr and the developing sleeve 41 by the distance D.

In FIG. 4, the solid line indicates the electric field dependency of the permittivity of the high permittivity carrier A, and the broken line indicates the electric field dependency of the permittivity of the low permittivity carrier B.

It is understood from FIG. 4 that the tilt of the relative permittivity with respect to the electric field intensity is greater in the high permittivity carrier A than in the low permittivity carrier B.

The high permittivity carrier A and the low permittivity carrier B are the carrier whose relative permittivity ∈ changes from ∈A1=12 to ∈A2=43 and the carrier whose relative permittivity ∈ changes from ∈B1=7 to ∈B2=10, respectively, when the electric field intensity changes from E1 to E2 in FIG. 4.

Figure 6:
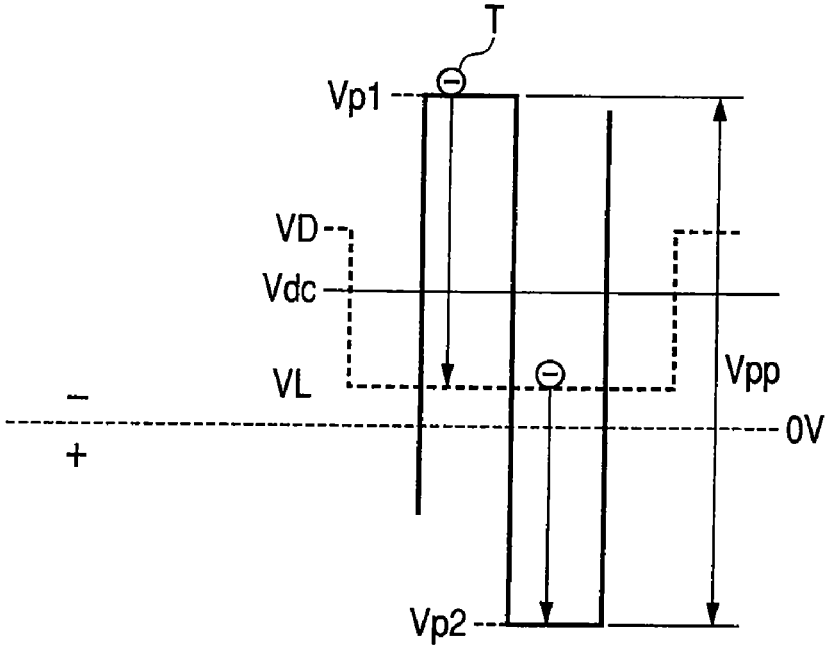
FIG. 6 is an explanatory diagram illustrating a relation between the developing bias and an electric potential of an electrostatic image.

FIG. 6 illustrates the electric potential of the electrostatic image on the photosensitive member 1 and the developing bias applied to the developing sleeve 41 in the developing operation. In FIG. 6, the axis of abscissa illustrates the time and the axis of ordinate illustrates the electric potential.

The developing bias employed in this embodiment is ordinary developing bias of rectangular wave (alternating bias). This developing bias superimposes a DC voltage component denoted by Vdc with an AC voltage component (peak-to-peak voltage Vpp: peak electric potentials Vp1 and Vp2). The developing bias is applied between the electrostatic image on the photosensitive member 1 and the developing sleeve 41.

The description here is given on the premise that this embodiment employs an image exposure method in which an electrostatic image is formed by exposing an image portion to light. In other words, of a dark part and a light part in an electrostatic image, the image portion is the light part. Another premise of the description is that the photosensitive member 1 in this embodiment is charged with negative electric charges. The description also assumes that the toner in this embodiment is charged with negative electric charges through charging by friction with the carrier, and that this embodiment employs a reverse developing method in which there is used a toner charged by friction with electric charges of the same polarity as the charging polarity of the photosensitive member (a developing method in which an exposed image portion on the photosensitive member is developed).

In FIG. 6, VD represents the charging potential (dark part potential) of the photosensitive member 1, and the photosensitive member 1 in this embodiment is charged with negative electric charges by the charger 2. VL in FIG. 6 represents the electric potential of a region in the image portion that is exposed to light by the exposure device 3, in other words, light part potential, and is an electric potential for obtaining the maximum density. The VL potential portion is accordingly a region where the maximum amount of toner adheres.

Rectangular wave developing bias is applied to the developing sleeve 41 as mentioned above. Therefore, in a period where the developing sleeve 41 is given the potential Vp1 out of the peak potentials, the maximum potential difference from the VL potential is created, and an electric field resulting from this potential difference (hereinafter referred to as "development electric field") makes the toner migrate to the photosensitive member 1. In a period where the developing sleeve 41 is given the potential Vp2, on the other hand, a potential difference from the VL potential is created in a direction reverse to that of the potential difference that forms the development electric field, and the resultant electric field pulls back the toner from the VL potential portion toward the developing sleeve 41 (hereinafter referred to as "pull-back electric field").

Figure 7:
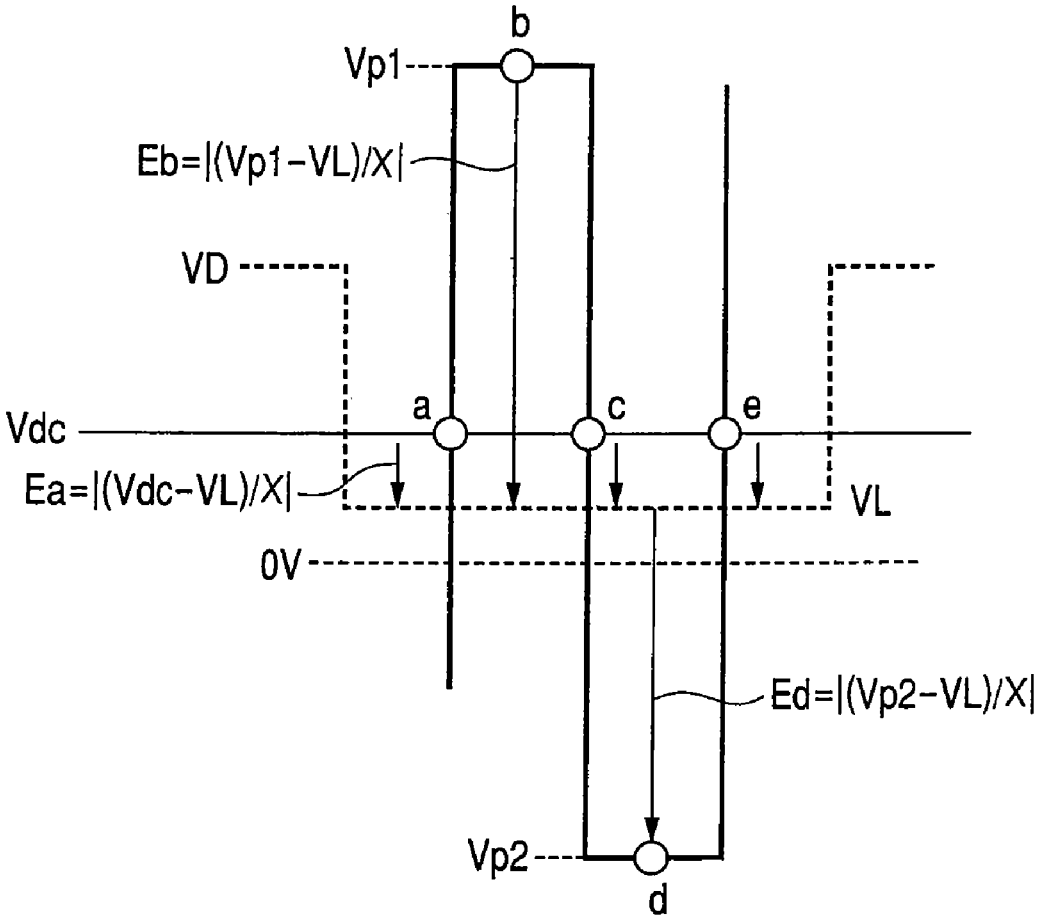
FIG. 7 is an explanatory diagram illustrating the relation between the developing bias and the electric potential of an electrostatic image.

Now, a change with time of the VL potential of the developing bias is discussed with reference to FIGS. 6 and 7. Electric field intensities Ea, Eb, Ec, Ed, and Ee at time points a, b, c, d, and e, respectively, in FIG. 7 are expressed by the following equations:

$$Ea=Ec=Ee=|(Vdc-VL)/X|$$

$$Eb=|(Vp1-VL)/X|$$

$$Ed=|(Vp2-VL)/X|$$

[where VL represents the electric potential [V] of the electrostatic image at which the maximum density is obtained, Vp1 represents, out of peak potentials in alternating bias, a peak potential [V] that provides such a potential difference from the VL potential that causes the toner to move toward the photosensitive member, Vp2 represents, out of peak potentials in alternating bias, a peak potential [V] that provides such a potential difference from the VL potential that causes the toner to move toward the developing sleeve, Vdc represents the DC bias component [V] of the developing bias, and D represents the closest distance [m] between the photosensitive member 1 and the developing sleeve 41.]

Vp1 and Vp2 are expressed by the following equations depending on the charging polarity of the toner:

When the toner polarity is negative: Vp1=Vdc−|Vpp/2|

When the toner polarity is positive: Vp1=Vdc+|Vpp/2|

When the toner polarity is negative: Vp2=Vdc+|Vpp/2|

When the toner polarity is positive: Vp2=Vdc−|Vpp/2|

[where Vpp represents the peak-to-peak voltage [V] in alternating bias, and

Vdc represents the DC bias component [V] of the developing bias.]

In short, the electric field intensities Ea, Ec, and Ee are obtained by dividing a potential difference between the DC bias component of the developing bias and the electric potential of the maximum density portion (VL potential) of the electrostatic image on the photosensitive member 1 by the distance D at a position where the photosensitive member 1 and the developing sleeve 41 are in the closest proximity to each other. The electric field intensity Eb (development electric field intensity) is obtained by dividing a potential difference between a peak potential that provides such a potential difference from the VL potential on the photosensitive member 1 that forms an electric field for moving the toner toward the photosensitive member 1 and the VL potential on the photosensitive member 1 by the closest distance X between the photosensitive member 1 and the developing sleeve 41. The electric field intensity Ed (pull-back electric field intensity) is obtained by dividing a potential difference between a peak potential that provides such a potential difference from the VL potential on the photosensitive member 1 that forms an electric field for moving the toner toward the developing sleeve 41 and the VL potential by the closest distance X between the photosensitive member 1 and the developing sleeve 41.

Figure 8:
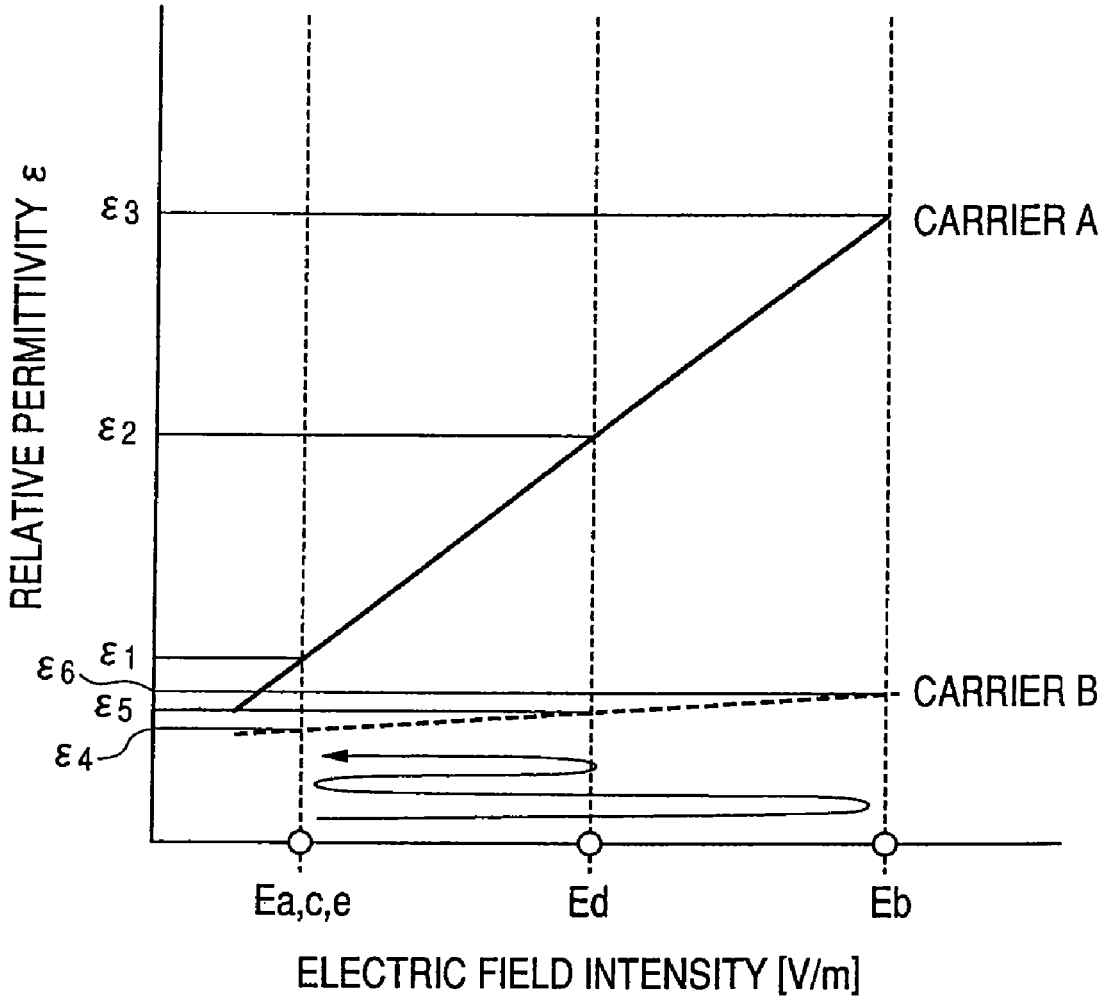
FIG. 8 is a graph illustrating the permittivity fluctuations of the carriers while the developing bias is applied.

The permittivity of a carrier is dependent on the electric field as has been described with reference to FIG. 4. Under the application of the developing bias, the relative permittivity of a carrier therefore changes in response to the changes in electric field intensity in order of Ea→Eb→Ec→Ed→Ee as illustrated by the arrow in FIG. 8.

For example, the relative permittivity of the high permittivity carrier A changes in order of ∈1→∈3→∈1→∈2→∈1 whereas the relative permittivity of the low permittivity carrier B changes in order of ∈4→∈6→∈4→∈5→∈4. These changes in relative permittivity are plotted in relation to changes with time as illustrated in FIG. 9.

Figure 9:
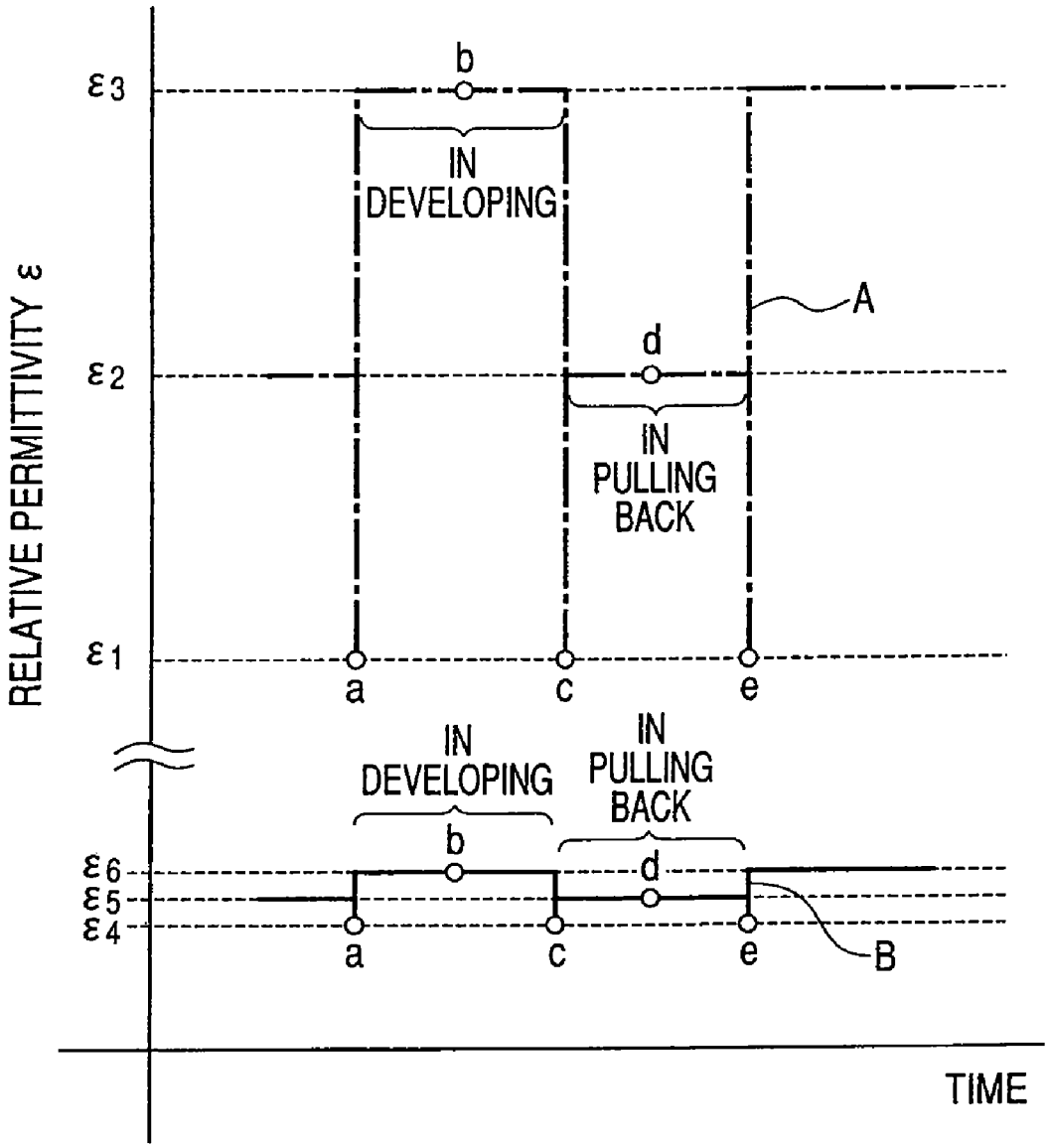
FIG. 9 is a chart illustrating permittivity fluctuations of carriers in relation to a change with time under an application of the developing bias.

FIG. 9 illustrates that the relative permittivity of the high permittivity carrier A when the development electric field is applied is relatively high at ∈3 whereas the relative permittivity of the low permittivity carrier B when the development electric field is applied is about ∈6 and relatively low. The rate of increase in carrier permittivity when the development electric field is applied is thus smaller in the low permittivity carrier B than in the high permittivity carrier A. This difference creates a difference in internal voltage drop between carriers, and ultimately creates a difference in development property.

Figure 10:
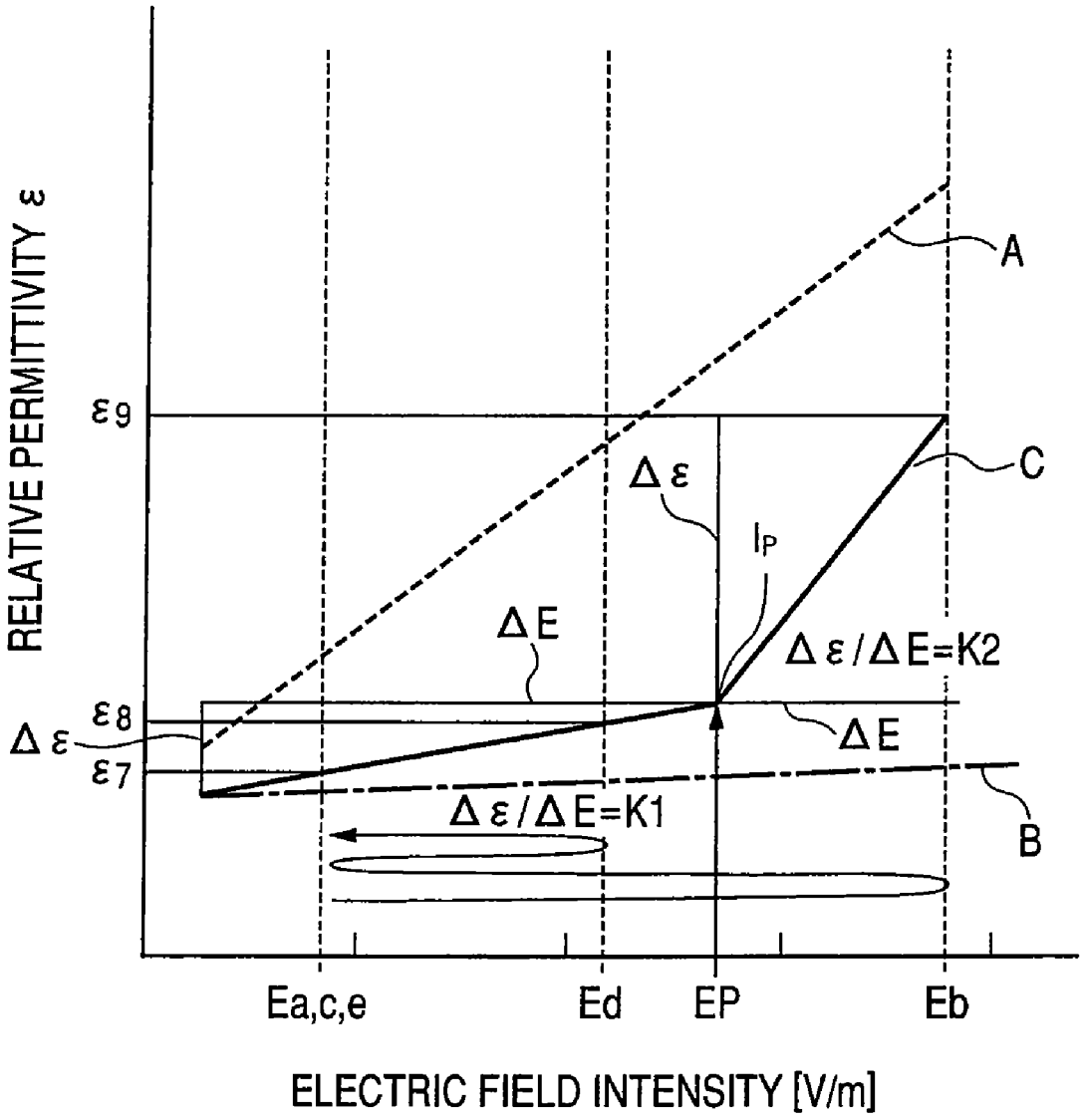
FIG. 10 is a graph illustrating the permittivity fluctuations of the carriers while the developing bias is applied.

FIG. 10 illustrates the electric field dependency of the permittivity of the carrier C according to this embodiment (hereinafter simply referred to as "carrier C").

The permittivity of the carrier C is dependent on the electric field as is the case for the high permittivity carrier A and the low permittivity carrier B. However, as can be seen in FIG. 10, the carrier C has a characteristic that makes the slope of the electric field dependency of the permittivity of the carrier C sharp at a given electric field intensity Ep (inflection point P).

The permittivity ∈ of the carrier C is slanted (slope=Δ∈/ΔE) with respect to the change of the electric field intensity E (=ΔV/D), which is obtained by dividing the potential difference ΔV between the electric potential of the developing sleeve 41 and the electric potential of the electrostatic image on the photosensitive member 1 by the closest distance D between the photosensitive member 1 and the developing sleeve 41. The characteristic of the carrier C is such that the slope (Δ∈/ΔE) of the electric field dependency of the permittivity ∈ changes at the electric field intensity Ep, which satisfies a relation Ed<Ep<Eb.

As illustrated in FIG. 10, the carrier C satisfies |K1|<|K2| when K1 is given as the slope (Δ∈/ΔE) of the electric field dependency of the permittivity ∈ at an electric field intensity $E_X$, which satisfies a relation $E_X$<Ep, and K2 is given as the slope (Δ∈/ΔE) of the electric field dependency of the permittivity c at an electric field intensity $E_Y$, which satisfies a relation $E_Y$>Ep. The slope of the permittivity at the electric field intensity Ed is K1 and the slope of the permittivity at the electric field intensity Eb is K2. The slope |K2| of the permittivity at the electric field intensity Eb is therefore larger than the slope |K1| of the permittivity at the electric field intensity Ed.

When the above-described developing bias is applied to the carrier C, the relative permittivity of the carrier C changes in order of ∈7→∈9→∈7→∈8→∈7 in response to the changes in electric field intensity in order of Ea→Eb→Ec→Ed→Ee as illustrated in FIG. 10.

Figure 12A:
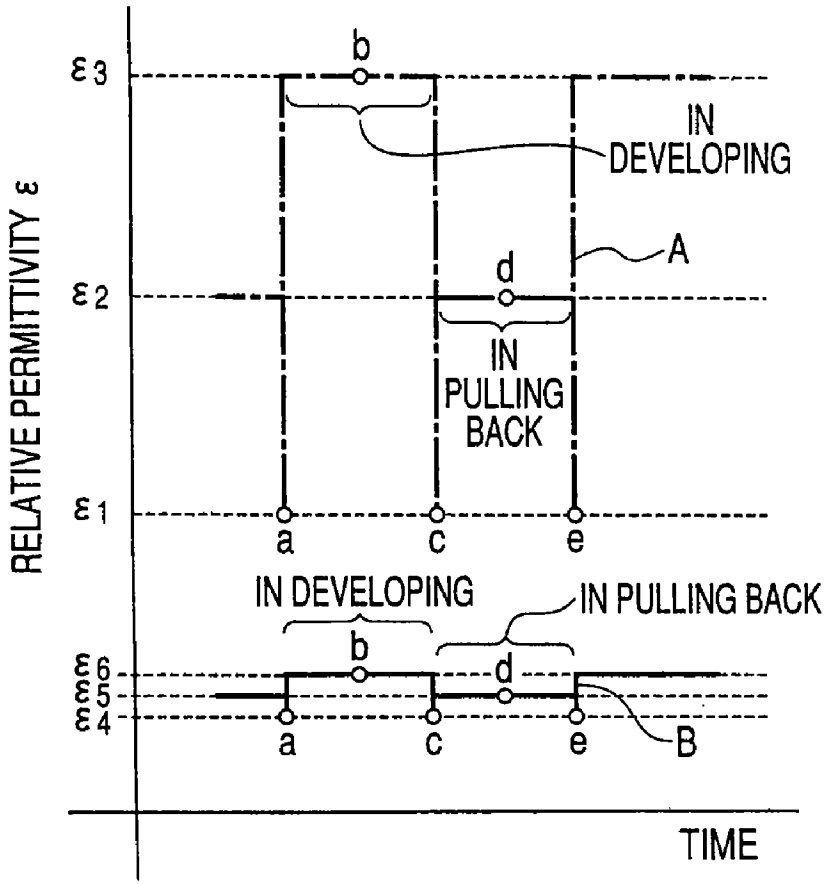
FIGS. 12A and 12B are charts illustrating permittivity fluctuations of the carriers in relation to a change with time under the application of the developing bias.
Figure 12B:
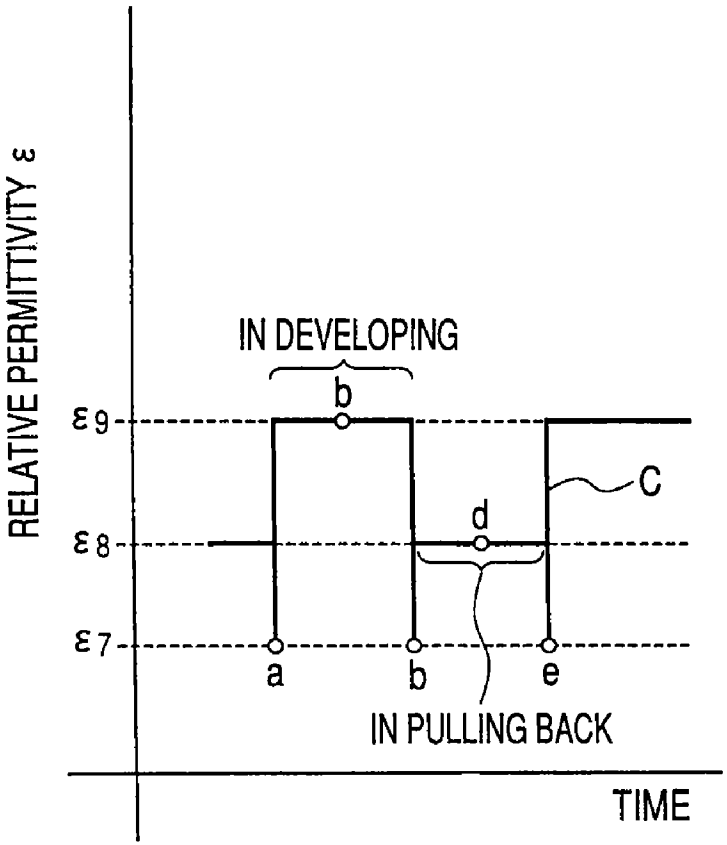

These changes in permittivity of the carrier C are plotted in relation to changes with time as illustrated in FIG. 12B. FIG. 12A illustrates permittivity changes in the carrier A and the carrier B (similar to FIG. 9).

FIG. 12B illustrates that the relative permittivity of the carrier C is rather high at ∈9 while the development electric field (electric field intensity Eb) is applied, whereas the relative permittivity of the carrier C remains rather low at ∈8 while the pull-back electric field (electric field intensity Ed) is applied.

The permittivity of the carrier C rapidly increases only when the development electric field Eb is formed, and the voltage drop inside the carrier due to carrier polarization is reduced, which enhances the electric field formed around the carrier, in other words, increases the actual electric field to which the toner is subjected. The toner is accordingly detached from the carrier more easily with the carrier C than with the low permittivity carrier B.

When the pull-back electric field Ed is formed, on the other hand, the permittivity of the carrier C is low, which increases the voltage drop inside the carrier and weakens the electric field formed around the carrier. Accordingly, when the pull-back electric field is applied, there is less chance for the toner to be pulled back to the carrier from the photosensitive member 1 to be confined with the carrier C than with the high permittivity carrier A.

The permittivity of the carrier C is thus increased only when the development electric field Eb is applied, and a good development property is ensured as is the case for the high permittivity carrier A, whereas the carrier C maintains a low permittivity and the pull-back force is weakened when the pull-back electric field Ed is applied. As a result, the overall development property is higher with the carrier C than with the high permittivity carrier A or the low permittivity carrier B. It is thus important that the carrier C be given a characteristic that makes the permittivity slope K2 at the electric field intensity Eb larger than the permittivity slope K1 at the electric field intensity Ed.

A schematic description on the permittivity characteristic of the carrier C has been given above. Employing a carrier that has an electric permittivity characteristic like the above-described permittivity characteristic of the carrier C enhances the development property exponentially, compared with the case where the high permittivity carrier A or the low permittivity carrier B is employed. In other words, employing a carrier that has the above-mentioned structure enhances the development property of a high charge amount toner exponentially, and enables an image forming apparatus to form high definition images steadily for a long period of time despite the use of a photosensitive member that has a large capacitance.

According to a study made by the inventors of the present invention, an a-Si photosensitive member in general has a capacitance of $1.7\times10^{-6}$ F/m$^2$ or larger, and an OPC photosensitive member with a relatively thin film thickness can also have this level of capacitance. OPC photosensitive members are usually 20 μm or more in thickness and accordingly have a per-unit area capacitance of $1.7\times10^{-6}$ F/m$^2$ or smaller.

The per-unit area capacitance of the photosensitive member 1 can be calculated as follows:

$$C=(\in\times\in d)/d$$

C: capacitance

∈o: vacuum permittivity

∈d: permittivity of photosensitive member d: film thickness of photosensitive member The study by the inventors of the present invention has revealed that the present invention is very effective when the per-unit area capacitance of the photosensitive member 1 is $1.7\times10^{-6}$ F/m$^2$ or larger. To reduce blank spots in an image at the boundary between a maximum density image region and a halftone image region and other places, it is important that electric charges of the toner fill the latent image potential. The charging potential ΔV is expressed by the equation (1), and the charging efficiency (%) calculated by (charging potential ΔV/development contrast Vcont)×100 is desirably 90% or larger in order to reduce blank spots in an image.

Specific characteristics of the high permittivity carrier A, the low permittivity carrier B, and the carrier C according to the present invention are given below.

High Permittivity Carrier A

The high permittivity carrier A is, for example, a carrier that uses as a core material magnetite or ferrite whose magnetism is expressed by the following expression (1) or (2):

$$MO \cdot Fe_2O_3 \quad (1)$$

$$M \cdot Fe_2O_4 \quad (2)$$

where M represents tervalent, divalent, or univalent metal ion.

Examples of M include Be, Mg, Ca, Rb, Sr, V, Cr, Mn, Fe, Co, Ni, Cu, Zn, Y, Zr, Nb, Mo, Cd, Pb, and Li, which may be used alone or in combination.

A specific compound of metal compound particles that have the above magnetism is an iron-based oxide such as Cu—Zn—Fe-based ferrite, Mn—Mg—Fe-based ferrite, Mn—Mg—Sr—Fe-based ferrite, or Li—Fe-based ferrite.

The ferrite particles can be manufactured by a known method. In an example of the ferrite particle manufacturing method, a pulverized ferrite composition is mixed with a binder, water, a dispersant, an organic solvent, and the like, and particles are formed by the spray dryer method or the flow granulation method. The particles are then baked in a rotary kiln or a batch baking furnace at a temperature of 700° C. to 1,400° C., preferably 800° C. to 1,300° C. The particles are next classified with the use of a sieve to control the particle distribution, thereby obtaining core material particles for a carrier. The surface of the ferrite particles is coated with about 0.1 to 1.0 mass percent of silicon resin or other resin by dipping.

A carrier manufactured in this way is called herein as the high permittivity carrier A.

Low Permittivity Carrier B

Examples of the low permittivity carrier B include the following.

A first example uses as a core material a magnetic material-dispersed resin carrier that is manufactured by melting and mixing magnetite particles and thermal plastic resin and then pulverizing the mixture. A second example uses as a core material a magnetic material-dispersed resin carrier that is manufactured by melting and dispersing magnetite particles and thermal plastic resin in a solvent to obtain a slurry, and then spray-drying the slurry with a spray dryer or the like. A third example uses as a core material a magnetic material-dispersed resin carrier in which phenol is cured by a reaction of direct polymerization in the presence of magnetite particles and hematite particles. A carrier core material prepared as above is coated with 1.0 to 4.0 mass percent of thermal plastic resin or other resin by a floating layer coating device or the like.

A carrier manufactured in this way is called herein as the low permittivity carrier B.

Carrier C According to the Present Invention

The carrier C according to the present invention can be a resin-filled porous carrier in which a resin such as a silicone resin is poured into a porous core to fill air gaps in the core with the resin.

The carrier C prepared as above can be manufactured by, for example, the following method. First, a given amount of a metal oxide as the one used in the high permittivity carrier A, a given amount of iron oxide ($Fe_2O_3$), and a given amount of an additive are weighed and mixed together. Examples of the additive include an oxide of one or more elements belonging to Groups IA, IIA, IIIA, IVA, VA, IIIB, and VB of the periodic table, such as BaO, $Al_2O_3$, $TiO_2$, $SiO_2$, $SnO_2$, and $Bi_2O_5$. Next, the resultant mixture is pre-baked for five hours at a temperature of 700° C. to 1,000° C., and then pulverized into particles about 0.3 to 3 μm in diameter. A binder agent and also a foaming agent are added, if necessary, to the pulverized material, which are then spray-dried in a heating atmosphere at 100° C. to 200° C., and shaped into particles about 20 to 50 μm in diameter. The particles are then baked for eight to twelve hours at a sintering temperature of 1,000° C. to 1,400° C. in an inert gas atmosphere having an oxygen concentration of 5% or less ($N_2$ gas, for example). A porous core is thus obtained. Next, the porous core is filled with silicone resin by dipping to 8 to 15 mass percent, and the silicone resin is cured in an inert gas atmosphere at 180° C. to 220° C.

By controlling the degree of porousness of the core, the resistance of the core itself, and the amount of silicone resin or other resin filling the pores in the above manufacturing method, the electric field dependency of the permittivity of the carrier can be controlled with regard to the inflection point, the slopes K1 and K2, the permittivity when the electric fields Eb and Ed are applied, and other aspects.

Controlling the above items makes it possible to attain a desired balance between insulated portions and conductive portions inside the carrier C, and the amount of electric charges flowing through the carrier can thus be controlled.

For example, in the case of a carrier whose core is entirely made up of a conductive material like the high permittivity carrier A, electric paths are easily created within the carrier and between the carriers, and cause a rapid drop of resistance value. In the carrier C according to the present invention, on the other hand, the air gaps of the porous core are filled with resin, which blocks the flow of electric charges to a certain degree in the resin portion.

The application of the developing bias therefore does not cause a sharp permittivity in the carrier C, and the permittivity can be changed at a desired electric field intensity.

Specific examples of the present invention will be described below.

Specific Example

Figure 13:
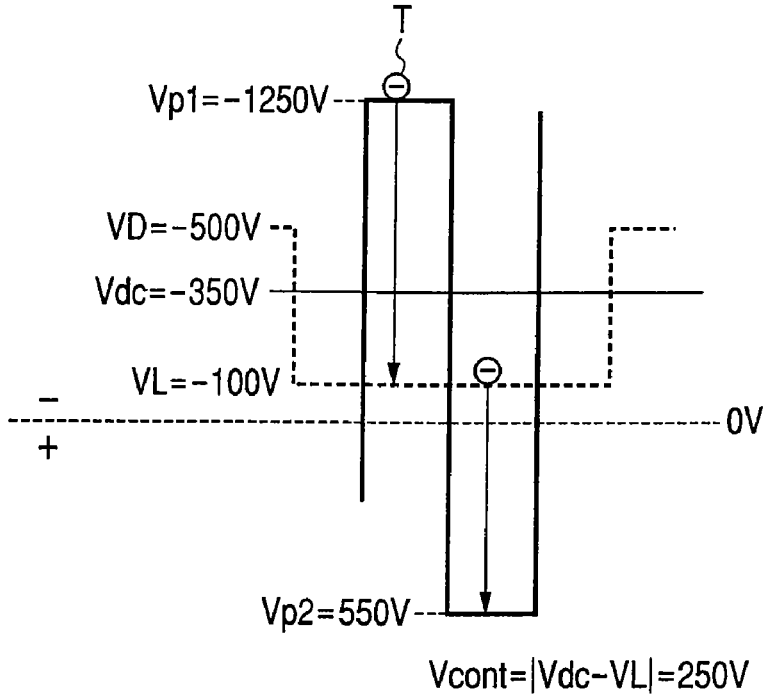
FIG. 13 is an explanatory diagram illustrating a relation between developing bias and an electric potential of an electrostatic image in a specific example.

FIG. 13 illustrates a specific example of the electric potential of the electrostatic image on the photosensitive member 1 and the developing bias applied to the developing sleeve 41 in an actual developing operation. In FIG. 13, the axis of abscissa illustrates the time and the axis of ordinate illustrates the electric potential.

This specific example employs, as the developing bias, rectangular wave developing bias (alternating bias) in which Vpp=1.8 kV, the DC voltage component Vdc=−350 V, and a frequency f=12 KHz (one cycle: 83.3 μsec). This developing bias is applied between the electrostatic image on the photosensitive member 1 and the developing sleeve 41.

The electrostatic image in this specific example is formed by the image exposure method. The toner in this specific example is charged with negative electric charges by friction with the carrier. The developing method employed in this specific example is the reverse developing method.

VD in FIG. 13 represents the charging potential of the photosensitive member 1, which is charged to −500 V by the charger 2 in this embodiment. VL in FIG. 13 represents a region in the image portion that is exposed to light by the exposure device 3 and is set to −100 V, which is an electric potential for obtaining the maximum density.

The rectangular wave developing bias as described above is applied to the developing sleeve 41. Therefore, when the Vp1 potential=−1250 V is given, the maximum potential difference (=1150 V) from the VL potential=−100 V is created, and the development electric field resulting from this potential difference detaches the toner from the carrier. When the developing sleeve 41 is given the potential Vp2=550 V, a 650 V potential difference from the VL potential is created, and the pull-back electric field is formed which pulls back the toner from the VL potential portion toward the developing sleeve 41.

Figure 14:
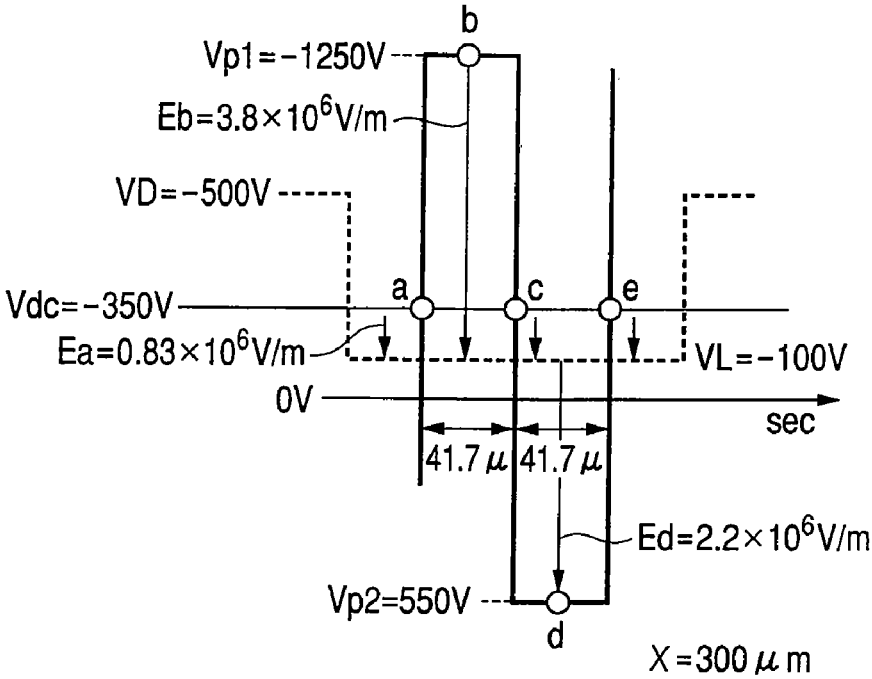
FIG. 14 is an explanatory diagram illustrating the relation between the developing bias and the electric potential of the electrostatic image in a specific example.
Figure 15:
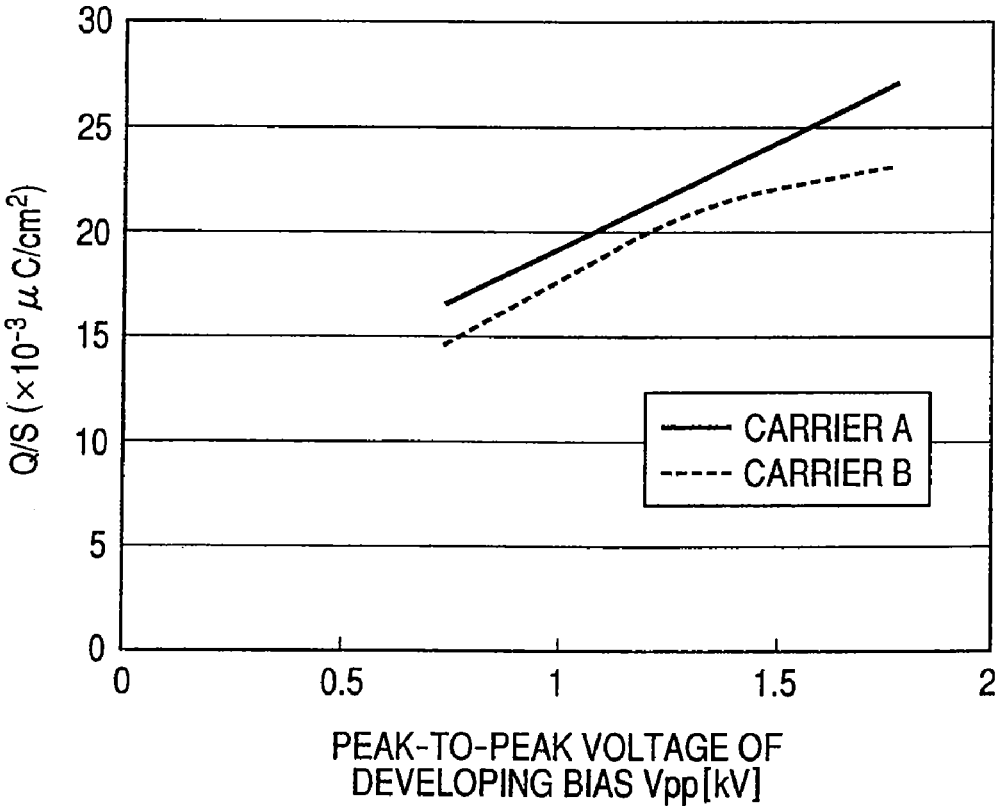
FIG. 15 is a graph illustrating a development property difference created by using different carriers.

A change with time of the VL potential of the developing bias is discussed with reference to FIG. 14. The electric field intensities Ea, Eb, Ec, and Ed at time points a, b, c, d, and e, respectively, in FIG. 7 are expressed by the following equations.

The closest distance X between the photosensitive member 1 and the developing sleeve 41 is set to 300 μm.

$$Ea=Ec=Ee=|(Vdc-VL)/X|=0.83\times10^{6}\text{V/m}$$

$$Eb=|(Vp1-VL)/X|=3.8\times10^{6}\text{V/m}$$

$$Ed=|(Vp2-VL)/X|=2.2\times10^{6}\text{V/m}$$

When the changes of the carrier permittivities under the application of the developing bias are plotted in relation to changes with time as illustrated in FIGS. 12A and 12B, the permittivities of the high permittivity carrier A, the low permittivity carrier B, and the carrier C according to the present invention are as follows.

High permittivity carrier A: ∈1=15, ∈2=26, ∈3=40

Low permittivity carrier B: ∈4=7, ∈5=8, ∈6=9

Carrier C of the present invention: ∈7=9, ∈8=12, ∈9=30

The permittivities of the respective carriers are compared. At the development electric field Eb, the permittivity of the high permittivity carrier A is the highest at ∈3, the permittivity of the carrier C of the present invention is the second highest at ∈9, and the permittivity of the low permittivity carrier B is the lowest at ∈6. The intensity of the electric field for detaching the toner from the carrier is accordingly highest with the high permittivity carrier A, the second highest with the carrier C of the present invention, and the lowest with the low permittivity carrier B.

The carriers' permittivities in the case of the pull-back electric field are compared next. At the pull-back electric field Ed, too, the permittivity of the high permittivity carrier A is the highest at ∈2, the permittivity of the carrier C of the present invention is the second highest at ∈8, and the permittivity of the low permittivity carrier B is the lowest at ∈5. The intensity of the electric field for pulling back the toner also is accordingly highest with the high permittivity carrier A, the second highest with the carrier C of the present invention, and the lowest with the low permittivity carrier B.

Detaching more toner particles from the carrier while allowing fewer toner particles to be pulled back is an effective way of improving the development property. With the high permittivity carrier A, the intensity of the electric field for developing the toner is high but the intensity of the pull-back electric field is equally high, and Q/S which indicates the development property is $27\times10^{-3}$ [μC/cm$^2$]. With the low permittivity carrier B, the pull-back electric field is weak but the development electric field is also weak, and the development property is accordingly low (Q/S=$23\times10^{-3}$ [μC/cm$^2$]). With the carrier C of the present invention, the intensity of the electric field for developing the toner is high whereas the pull-back electric field is weak, and accordingly a high development property (Q/S=$35\times10^{-3}$ [μC/cm$^2$]) is obtained.

In another specific example, when Vpp is 1.3 kV, for instance, the development electric field Eb is $3.0\times10^{6}$ V/m and the pull-back electric field Ed is $1.3\times10^{6}$ V/m.

At Vpp=1.3 kV, which sets the development electric field Eb to $3.0\times10^{6}$ V/m and the pull-back electric field Ed to $1.3\times10^{6}$ V/m, the permittivity of the carrier C according to the present invention is such that the resultant Q/S value [C/cm$^2$] is not higher than the ones obtained when the high permittivity carrier A is employed and when the low permittivity carrier B is employed. Therefore, a carrier D will be used in the comparison instead of the carrier C. The carrier D is manufactured by the same method as the carrier C of the present invention, but has, for example, a different degree of core porousness, a different core resistance, and a different amount of silicone resin or other resin filling the pores by changing the baking temperature and the heating atmosphere from those used in creating the carrier C.

Figure 11:
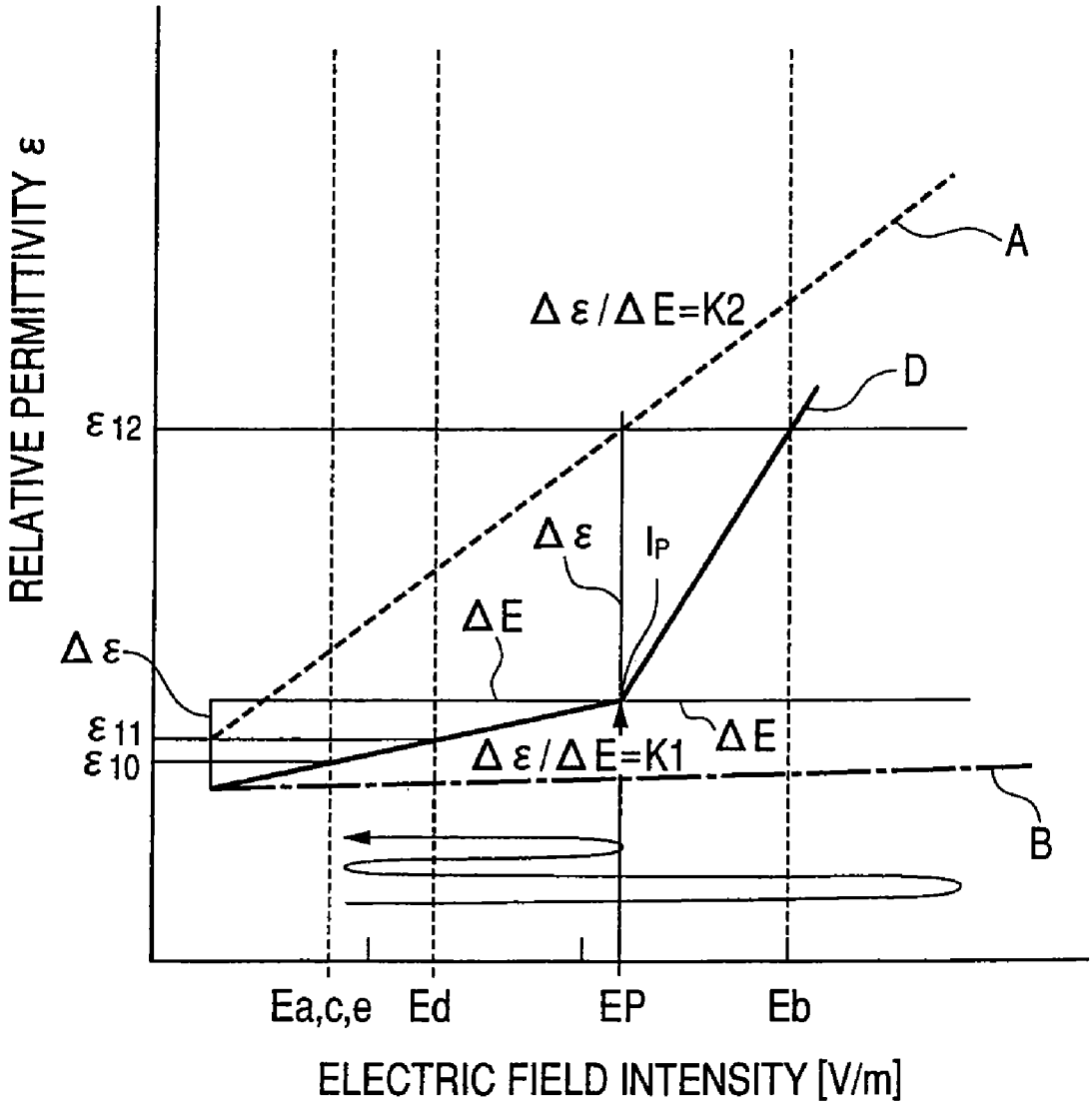
FIG. 11 is a graph illustrating the permittivity fluctuations of the carriers while the developing bias is applied.

The electric field dependency of the permittivity of the carrier D according to the present invention is illustrated in FIG. 11. It is understood from FIG. 11 that the change of the permittivity slope occurs for the carrier D at a lower electric field than for the carrier C. The permittivity of the carrier D is similar to the permittivity of the carrier C in that the relative permittivity is rather high at ∈12 while the development electric field (electric field intensity Eb) is applied whereas the relative permittivity remains rather low at ∈11 during the application of the pull-back electric field (electric field intensity Ed).

At Vpp=1.3 kV, which sets the development electric field Eb to $3.0\times10^{6}$ V/m and the pull-back electric field Ed to $1.3\times10^{6}$ V/m, the permittivities of the high permittivity carrier A, the low permittivity carrier B, and the carrier D according to the present invention are as follows.

High permittivity carrier A: ∈1=15, ∈2=19, ∈3=33

Low permittivity carrier B: ∈4=7, ∈5=7, ∈6=8

Carrier D of the present invention: ∈10=8, ∈11=10, ∈2=29

Regarding the low permittivity carrier B, ∈4 is expressed to be equal to ∈5 but actually ∈4 is smaller than ∈5. This is because actual values of ∈4 and ∈5 are rounded off to the whole number. That is, the permittivity of the low permittivity carrier B does not have no slope in a region from the intensity of the electric field Ea, Ec, Ee to the intensity of the electric field Ed in FIG. 11.

The comparison results when Vpp is 1.3 kV are the same as when Vpp is 1.8 kV. With the high permittivity carrier A, the intensity of the electric field for developing the toner is high but the intensity of the pull-back electric field is equally high, and accordingly the development property is not so high (Q/S=$22\times10^{-3}$ [μC/cm$^2$]). With the low permittivity carrier B, the pull-back electric field is weak but the development electric field is also weak, and the development property is accordingly low (Q/S=$21\times10^{-3}$ [μC/cm$^2$]). With the carrier D of the present invention, the intensity of the electric field for developing the toner is high whereas the pull-back electric field is weak, and accordingly a high development property (Q/S=$27\times10^{-3}$ [μC/cm$^2$]) is obtained.

Thus, the development property can be improved in a wide range of electric field fields by varying the degree of porousness of the core, the resistance of the core itself, the amount of silicone resin or other resin filling the pores, and the like.

The charge injection during development can be prevented by lowering Vpp as mentioned above. However, lowering Vpp induces a corresponding decrease in intensity of the electric field for developing the toner and affects the development property itself. It is therefore undesirable to lower Vpp limitlessly.

According to the study conducted by the inventors of the present invention, although the appropriate Vpp value varies depending on the attractive force between the employed toner and carrier, the following is preferably fulfilled (Eb is larger than Ed).

$1.6\times10^6$V/m<$Eb$<$3.9\times10^6$V/m $1.6\times10^5$V/m<$Ed$<$2.5\times10^6$V/m The present invention has been described above through the specific embodiment. However, it should be understood that the present invention is not limited to the above embodiment and specific examples.

For instance, while the photosensitive member is charged with negative electric charges and the electrostatic image is formed on the photosensitive member by the image exposure method in the above embodiment and specific examples, the present invention is not limited thereto and the charging polarity of the photosensitive member may be positive. The electrostatic image on the photosensitive member may be formed by a background exposure method in which an electrostatic image is formed by exposing a non-image portion to which no toner should adhere. Also, the developing method employed may be the regular developing method in which the toner is charged with electric charges whose polarity is reverse to the charging polarity of the photosensitive member (method in which an unexposed image portion of the photosensitive member is developed).

According to the present invention, in an image forming apparatus that uses a dual-component developer including a toner and a carrier, an excellent development property is obtained while preventing the injection of electric charges into an electrostatic image through the carrier.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-112424, filed Apr. 20, 2007, and No. 2008-105178, filed Apr. 14, 2008, which are hereby incorporated by reference herein in their entirety.

What is claimed is:

1. An image forming apparatus comprising:

an image bearing member; and a developer carrying member which carries a developer including a toner and a carrier, the developer carrying member developing with the developer an electrostatic image formed on the image bearing member, the developer carrying member being applied with alternating voltage so that an alternating electric field is formed between the developer carrying member and the image bearing member, wherein, in a graph whose axis of abscissa illustrates an electric field intensity to which the carrier is subjected and whose axis of ordinate illustrates a permittivity of the carrier, when:

a slope of the graph at an electric field intensity Ed=|(Vp2−VL)/X| is given as K1; and a slope of the graph at an electric field intensity Eb=|(Vp−VL)/X| is given as K2, a relation |K1|<|K2| is satisfied, where:

VL represents a potential [V] of the electrostatic image at which a maximum density is obtained;

Vp1 represents, out of peak potentials in the alternating voltage, a peak potential [V] that provides such a potential difference from the VL potential that moves the toner toward the image bearing member;

Vp2 represents, out of peak potentials in the alternating voltage, a peak potential [V] that provides such a potential difference from the VL potential that moves the toner toward the developer carrying member; and X represents a closest distance [m] between the image bearing member and the developer carrying member, and wherein the carrier comprises a porous core filled with a resin.

2. An image forming apparatus according to claim 1, wherein the resin is a silicone resin.

3. An image forming apparatus according to claim 1, wherein ranges of the electric field intensity Eb and the electric field intensity Ed satisfy the following relationships:

$1.6\times10^6$V/m<$Eb$<$3.9\times10^6$V/m $1.6\times10^5$V/m<$Ed$<$2.5\times10^6$V/m.

4. An image forming apparatus according to claim 1, wherein the image bearing member has a capacitance of $1.7\times10^{-6}$ F/m$^2$ or larger.

5. An image forming apparatus according to claim 1, wherein the image bearing member comprises a photosensitive member, and the photosensitive member includes an amorphous silicon layer.

6. An image forming apparatus according to claim 1, wherein the image bearing member comprises a photosensitive member, and the photosensitive member includes an organic photoconductor layer.

* * * * *